US008387215B2

(12) United States Patent
Koncelik, Jr.

(10) Patent No.: US 8,387,215 B2
(45) Date of Patent: Mar. 5, 2013

(54) METHOD AND APPARATUS FOR CABLE TIES

(76) Inventor: Lawrence J. Koncelik, Jr., East Hampton, NY (US)

( * ) Notice: Subject to any disclaimer, the term of this patent is extended or adjusted under 35 U.S.C. 154(b) by 170 days.

(21) Appl. No.: 13/069,003

(22) Filed: Mar. 22, 2011

(65) Prior Publication Data

US 2012/0210541 A1 Aug. 23, 2012

Related U.S. Application Data

(60) Provisional application No. 61/463,786, filed on Feb. 22, 2011.

(51) Int. Cl.
*B65D 63/06* (2006.01)
*B65D 63/00* (2006.01)

(52) U.S. Cl. ..... 24/16 PB

(58) Field of Classification Search ..... 24/16 PB, 24/16 R, 17 A, 17 AP, 20 R, 22, 26, 27, 29
See application file for complete search history.

(56) References Cited

U.S. PATENT DOCUMENTS 3,409,948 A * 11/1968 Goodwin ..... 24/16 R
3,426,393 A * 2/1969 Mead ..... 24/30.5 T
3,438,095 A * 4/1969 Evans ..... 24/16 PB
3,857,139 A * 12/1974 Turner ..... 24/30.5 T
4,477,950 A * 10/1984 Cisek et al. ..... 24/30.5 P
4,730,615 A * 3/1988 Sutherland et al. ..... 606/215
4,915,996 A * 4/1990 Curry ..... 428/40.9
5,005,264 A * 4/1991 Breen ..... 24/30.5 R
5,342,687 A * 8/1994 Iwai et al. ..... 428/402
5,366,461 A * 11/1994 Blasnik ..... 606/151
5,636,412 A * 6/1997 Lodi et al. ..... 24/16 PB
5,732,495 A * 3/1998 Lowe et al. ..... 40/665
5,766,218 A * 6/1998 Arnott ..... 606/151
5,799,376 A * 9/1998 Harsley ..... 24/16 PB
6,673,413 B1 * 1/2004 Kincel et al. ..... 428/99
7,011,879 B1 * 3/2006 Contreras et al. ..... 428/99
7,704,587 B2 4/2010 Harsley ..... 428/136
2008/0222853 A1 * 9/2008 Zavattieri et al. ..... 24/20 R
2009/0235494 A1 * 9/2009 Browne et al. ..... 24/16 R
2010/0109322 A1 5/2010 Zavattieri ..... 285/381.2

* cited by examiner

*Primary Examiner* — Robert J Sandy
*Assistant Examiner* — David Upchurch
(74) *Attorney, Agent, or Firm* — Walter J. Tencza, Jr.

(57) ABSTRACT

A cable tie comprising a strap portion having a first end and an opposing second end. The cable tie may also include a fastener connected to the second end of the strap portion. The strap portion may include a first material which causes the strap portion to be non self reforming so that the strap portion can be bent from an equilibrium state to a bent state by a bending force which does not exceed a plasticity point for the strap portion, and the strap portion does not reform itself back to the equilibrium state upon removal of the bending force.

18 Claims, 13 Drawing Sheets

METHOD AND APPARATUS FOR CABLE TIES

CROSS REFERENCE TO RELATED APPLICATION(S)

This application claims the priority of U.S. provisional patent application Ser. No. 61/463,786, filed on Feb. 22, 2011, titled "SHAPEABLE CABLE TIE", inventor and applicant Lawrence J. Koncelik, Jr.

FIELD OF THE INVENTION

This invention relates generally to cable ties and their accessories.

BACKGROUND OF THE INVENTION

A cable tie, which may also be called a zip tie and/or tie-wrap, is a type of fastener, which is often typically used for binding a plurality of electronic cables or wires together and to organize cables and wires. Cable ties are used to bundle a plurality of items together in an efficient and quick manner.

A conventional cable tie is generally constructed of a linear semi rigid resiliently bendable material that can be bent to form a loop and the loop can be secured with a fastening mechanism integrated with the cable tie. The loop formed is not self sustaining since the material from which this sort of cable tie is made does not hold the shape which has been formed by bending. This type of cable tie is elastic and, unless the cable tie is bended so far that it reaches a state of placidity and becomes floppy, it recoils to its original linear shape.

The conventional cable tie comprises a strap that is made of a resiliently bendable material such as nylon or plastic or copper or stainless steel alloy or metal alloy that can be bent to form a loop but will not hold the bend or the loop. I.e. these cable ties are self reforming or elastic. This type of cable tie will revert substantially to its linear form when the tensile strain used to bend it is no longer applied. A tail portion of this conventional cable tie can be inserted into an aperture in the head of the conventional cable tie. On insertion of the tail portion into the aperture of the head, latches spaced along the surface of the tail portion engage teeth in the head and thereby prevent the withdrawal of the tail. In this way, the loop in the cable tie can be prevented from reforming to its pre-deformed shape.

Another kind of cable tie that contains a fastening mechanism comprises an elastically rubberized strap of cells that contain apertures wherein the cells slide through each other forming loops at any point, which can then be pulled tight around a bundle of objects. After the cable tie is pulled tight into a loop, the remaining portion can be cut off and used. As a result a cable tie of this strap of cells type can be used or cut up into several cable ties, and just gets a little shorter with each use. One type of cable tie such as this is disclosed in U.S. Pat. No. 7,704,587 to Harsley, which is incorporated herein by reference and made a part hereof. Because the strap of cells type of cable tie is made of an elastic material it stretches longer when longitudinal stress is exerted upon it, and reforms towards its pre deformed shape when the stretching force is no longer applied. This strap of cells kind of cable tie is often referred to as a "rap strap".

Another type of known cable tie that includes a fastening mechanism is a strap made of hook and loop fasteners. The strap consists of two layers: a "hook" side, which is a piece of fabric covered with tiny plastic hooks, and a "loop" side, which is covered with even smaller and "hairier" plastic loops. Like all other known cable tie fasteners that contain a fastening mechanism, these hook and loop type of fasteners are not shapeable in the sense that they do not hold the shape that they are formed to. While a cable tie made of a resiliently flexible material does not sustain its own shape because it tends to reform to its pre deformed shape after the tensile strain used to bend it is no longer applied, a cable tie such as a rap strap or a cable tie made with hook and loop fastening material can not hold its own shape for a different reason. The material used in these later cable ties are so flaccid that they do not hold the shape they are formed to against the force of gravity.

One of the major disadvantages of the prior art cable ties with integrated fastening mechanisms is that these cable ties are not comprised of a bendable shapeable, non reforming material As such, it is difficult to use the cable tie when it is necessary to thread one end of such prior art cable ties through, or in between voids in a confined area. For example when a particular application requires that a cable tie with a fastening head, be threaded in and around hard to reach objects the task is made more difficult when the cable tie tends to revert to its original shape. Likewise, the task is difficult when a cable tie that comprises a floppy, non rigid material is used. While a resiliently bendable, flexible, cable tie can be bent to a point of plasticity or near plasticity so that it is shaped to form a loose curve that approximates the contours of the receiving channel into which it is to be treaded, this is a time consuming task that results in a cable tie whose structure has been compromised by the extreme bending, and as such, the formerly semi rigid flexible cable tie becomes excessively floppy and unmanageable.

The prior art discloses a type of cable tie that can be bent to a self sustaining shape but this type of cable tie does not contain a fastening mechanism. Such a cable tie is often called a "twist tie". A major feature of a twist tie that is absent in a cable tie comprising a fastening mechanism is that a twist tie can be shaped into a form and the form will retain its shape until reformed by a user. A twist tie is comprised of a shapeable and bendable wire that is embedded in paper or plastic. It is often used to close off a plastic bag that contains a perishable item, such as bags of bread. A twist tie can be formed into a loop that can be secured in size by twisting the twist tie around itself. However, because these twist ties do not contain a fastening mechanism, they do not have all the same benefits as a cable tie containing a fastening mechanism, for instance, a loop cannot be fastened quickly as a loop can be with a cable tie.

A disadvantage of twist ties is that they do not contain an integrated fastening mechanism. Thus, although a twist tie can be pre formed, it does not have the capability of being quickly, securely and easily fastened together as does a cable tie that contains a fastening mechanism. A twist tie has to be manually twisted, or tied together, and this can be time consuming and cumbersome and often results in a less than adequate connection.

SUMMARY OF THE INVENTION

One or more embodiments of the present invention provide a cable tie strap that contains a fastening mechanism and that can be bent into a self sustaining form. Such a cable tie may be comprised of a bendable, shapeable, linear material that can be bent to form a self sustaining loop. The bendable shapeable material may be a soft bendable wire, or any other type of bendable, shapeable material that does not revert to its pre deformed shape when the force that causes the wire (or other bendable shapeable material) to bend is no longer applied. The cable tie strap may comprise only the bendable, shapeable, material or the cable tie could have a bendable shapeable material integrated with another material. The bendable shapeable wire can be any material with those characteristics such as, but not limited to, steel wire, copper wire, steel alloy or a plastic. The bendable material may be permanently mounted to, or embedded into or molded to the cable tie strap. Alternatively, the cable tie could be comprised of a bendable, shapeable material that is selectively attached to or detached from another material. For instance a bendable wire may be woven through apertures cut through the surface of the flexible strap. The bendable wire may be selectively removed from the strap by any means including pulling it from the cable strap. Or, the bendable wire may be selectively embedded into the second material. For instance a metal wire can be heated and melted into a plastic strap. The second material may have elasticity. The second material may be semi rigid and and/or resiliently deformable. An advantage of a cable tie that contains a fastening mechanism being able to hold its own shape is not only that the tie can be twisted around itself to form a loop, but also that the tie can be woven into and around hard to reach areas and then easily fastened together with the fastening mechanism. For instance, where a job requires threading a cable tie into a hole and then out through an exit hole that is 180 degrees in the opposite direction and finally securely fastened in place, it would be advantageous to use a cable tie that contains a fastening mechanism and that could be molded into a pre formed self sustaining configuration prior to the treading. The bendable, shapeable cable tie can be bent to varying degrees and hold different bends. For instance the cable tie can be bent to 70 degrees and hold that bend, and then, subsequently the same cable tie can be bent from the 70 degrees to, say, 45 degrees and hold the 45 degree bends. Thereafter it can be bended again from 45 degrees to 160 degrees and hold that angle until stress is applied to bend it to any different angle selected by the user.

It is the object of one or more embodiments of the present invention to provide an integral yieldable resistant cable tie with a fastening mechanism that can be pre formed by the user to form a non self reforming bend or a loop while not losing its original yieldable resistant characteristics.

It is another object of one or more embodiments of the present invention to provide a cable tie that can be fastened to itself by either twisting the cable tie around itself or by use of a fastening mechanism that is integrated with the cable tie.

It is another object of one or more embodiments of the present invention to provide a cable tie that is bendable, shapeable, not self reforming and that contains an integrated fastening mechanism so that the cable tie can be fastened to itself either by use of the fastening mechanism or by twisting the cable tie around itself. The cable tie could be preformed by a user to that it could be treaded though and in-between obstacles in close quarters that would be otherwise difficult to thread through.

It is another object of one or more embodiments of the present invention to provide a cable tie with an integrated fastening mechanism that comprises a shape memory alloy or plastic so that the cable tie can be bent by a user. In at least one embodiment, such a cable tie holds its own bend for a pre determined period of time before it returns from this deformed state (temporary shape) to its original (permanent) shape induced by an external stimulus (trigger), such as temperature or light, change in electric or magnetic field or a change in pH and the cable tie will hold its own shape for a pre determined period of time after it has been shaped by a user, before it reverts back to its original shape.

It is another object of one or more embodiments of the present invention to provide an cable tie that is bendable, shapeable, not self reforming where in the cable tie comprises a first elongated material that is a bendable, shapeable, not self reforming material and a second material which is an elastically bendable, resiliently resistant and self reforming, wherein the first material can be selectively detached from or attached to the second material.

In a preferred embodiment the cable tie comprises an elongated plastically bendable shaping member, and a fastening mechanism. The cable tie can be shaped to form a loop. The material is such that the formed loop will retain its shape after it is bent. The formed loop may be shaped to a size selected by a user and the loop can be held in place by the fastening mechanism. The cable tie containing a fastening mechanism can also be bent into self sustaining curves that are less than a complete loop or the cable tie can be bent so that it forms a plurality of loops. The non self reforming nature of the material that comprises the cable tie can be a rubberized plastic, a plastic, an alloy, a memory shaped material, or any material that can be formed into an elongated strap from which a loop can be formed and which will not, without outside stimulus recoil to its pre deformed linear shape.

A cable tie in accordance with one or more embodiments of the present invention, can be made of a combination of different materials, but regardless of the number of different materials that comprise the cable tie, the cable tie, in at least one embodiment, will ultimately be plastically bendable and shapeable and substantially not self reforming. For instance the cable tie can be made of a first material that is a resiliently bendable elastic strap that contains the fastening mechanism and a second material that comprises a plastically bendable shaping member that is substantially not self reforming. The second material can be attached to or integrated with the first material. The second material can be woven through holes that may be dispersed through the surface of the first material. Regardless of the nature and properties of the various materials the cable tie will ultimately be capable of being molded into a pre defined shape that will not revert to its original deformed configuration.

An elongated soft malleable wire is embedded into a length of the cable tie; the shaping nature of the embedded wire makes the cable tie shapeable along the length of the cable tie where the wire is embedded. Furthermore, a cable tie comprising a bendable material such as a bendable, shapeable steel alloy wire, can be fastened together to form a loop either with the mechanism that is integrated onto the cable tie, or it can be fastened together to form a loop by twisting one section of the cable tie around another section of the cable tie without use of the fastening mechanism. When one portion of the cable tie is fastened to another portion of the cable tie by twisting the first portion around the second portion the loop is so formed without having to tie the cable tie into a knot. The twisted cable keeps the loop in place without having to tie one end of the cable to the other and keeping it in place by knotting the tie. The loop can be taken out (i.e. become unfixed) by a user simply untwisting the cable tie and bending the cable tie to a different shape to its original deformed shape. Thus, a cable tie that is comprised of a shapeable, bendable, substantially non self reforming linear material and, which cable tie also contains a fastening mechanism, can be fastened into a loop in one of two ways: It could be bended to form a loop and held in place as such with the fastening mechanism, or it could be bent to form a loop which can be held in place by wrapping one portion of the cable tie around itself.

In an alternative embodiment, a shapeable bendable non self reforming wire, such as a copper wire could be embedded into, or attached to, a rubberized strap that contains a fastening mechanism, wherein the strap comprises a plurality of cells each of which has apertures such as a rap strap as is described above. The cable tie would be bendable and shapeable notwithstanding the elasticity of the strap because the bendable, shapeable wire causes the entire strap to hold the shape that it was bended into. A cable tie such as this could be formed into a fixed loop of a size selected by the user by the user inserting one end of the cable tie into an aperture in a cell, and, alternatively, the cable tie could be twisted around itself to so that a fixed loop is formed and untwisted to selectively deform the loop.

A cable tie containing a fastening mechanism can also be comprised of a, memory shaping material that has a temporary state wherein the cable tie is deformable, and wherein the cable tie can be actuated to transform to a stable memorized shape where the configuration of the memorized shape has been predetermined. The memory shaping cable tie can also be actuated to transform from the memorized shape back to the bendable shape The cable tie could be comprised, at least in part, of a shape memory alloy such as nickel-titanium "Nitinol" or shape memory plastic so that after the cable tie is bend to a certain shape determined by the user; it will remain non self reforming for a certain period of time depending on when the shape memory alloy or plastic starts to revert back to its original shape.

Importantly, the actual material from which the shaping member is made is not critical to the invention. However, it is desirable that the material can be repeatedly bent, plastically deformed, or otherwise manipulated and it will essentially retain its shape or configuration that it was placed in. Ideally, the material should be able to be repeatedly bent, plastically deformed, or otherwise manipulated and it will essentially retain its shape or configuration that it was placed in. The phrase "essentially retain its shape" is meant to allow some slight reformation, creep, or spring-back to the member.

The present application in one or more embodiments provides a cable tie comprising a strap portion having a first end and an opposing second end. The cable tie may also include a fastener connected to the second end of the strap portion. The strap portion may be comprised of a first material which causes the strap portion to be non self reforming so that the strap portion can be bent from an equilibrium state to a bent state by a bending force which does not exceed a plasticity point for the strap portion, and the strap portion does not reform itself back to the equilibrium state upon removal of the bending force. The first end of the strap portion and the fastener are configured so that the first end can be inserted into and through the fastener and after the first end has been inserted into and through the fastener, the first end cannot be pulled back through the fastener without unlocking a mechanism of the fastener.

The strap portion and the fastener may be integrated into one piece. The first material may be for example, a soft bendable metal wire, a metal alloy, a polymer, a metal wire, or a shape memory alloy. The strap portion and the fastener may be bio-degradable.

The strap portion may include a body portion in addition to the first material. In at least one embodiment, the first material may be selectively detached from the body portion of the strap portion. In another embodiment, the first material cannot be detached from the body portion of the strap portion without breaking the strap portion. In yet another embodiment, the first material may be woven through apertures that traverse the body portion. The body portion may be made of a second material, which is self reforming and bendable. The first material may be embedded in at least part of the body portion. The body portion is made of a second material which is resiliently flexible and self reforming. The first material may be embedded in the body portion.

A cable tie may also be provide comprising a strap portion having a first end and a second end, and having a plurality of connected cells between the first end and the second end. Each of the plurality of connected cells may form an enclosed aperture bounded by wall portions, so that a plurality of enclosed apertures are formed corresponding to the plurality of connected cells, each enclosed aperture allowing passage of one or more of the plurality of connected cells, wherein a loop can be formed by inserting the first end of the strap portion through a first enclosed aperture of the plurality of enclosed apertures. The plurality of connected cells may be configured so that the first end of the strap portion and one or more of the plurality of connected cells can be inserted into and through a first connected cell of the plurality of connected cells and after the first end and the one or more of the plurality of connected cells has been inserted into and through the first connected cell of the plurality of connected cells, one or more wall portions of one or more of the plurality of connected cells inhibit the first end from being moved back through the first connected cell of the plurality of connected cells. The strap portion may be comprised of a first material which causes the strap portion to be non self reforming so that the strap portion can be bent from an equilibrium state to a bent state by a bending force which does not exceed a plasticity point for the strap portion, and the strap portion does not reform itself back to the equilibrium state upon removal of the bending force.

DETAILED DESCRIPTION OF THE DRAWINGS

Figure 1A:
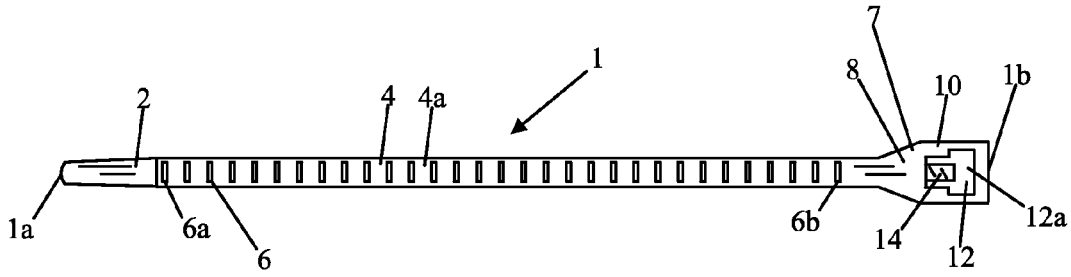
Fig. 1A (Prior Art)
FIG. 1A is a left side view of a cable tie of the prior art in an open state.
Figure 1B:
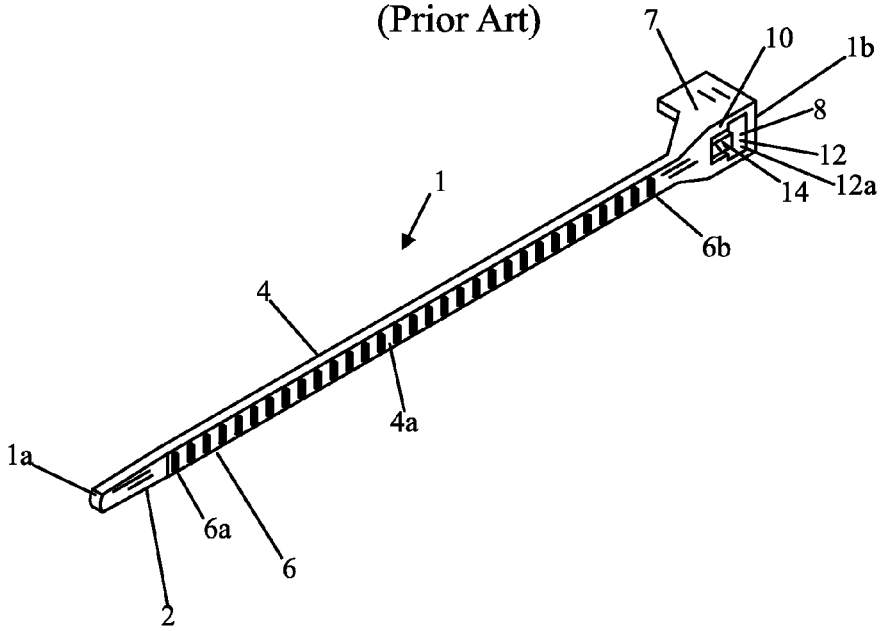
Fig. 1B (Prior Art)
FIG. 1B is a left, front, top perspective view of the cable tie of FIG. 1A in an open state.
Figure 2A:
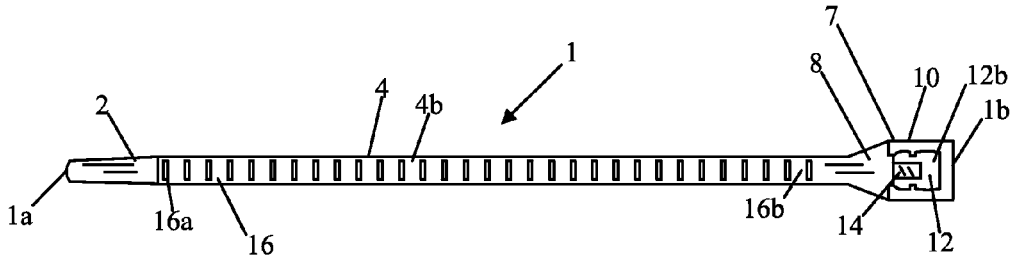
Fig. 2A (Prior Art)
FIG. 2A is a right side view of the cable tie of FIG. 1A in an open state.
Figure 2B:
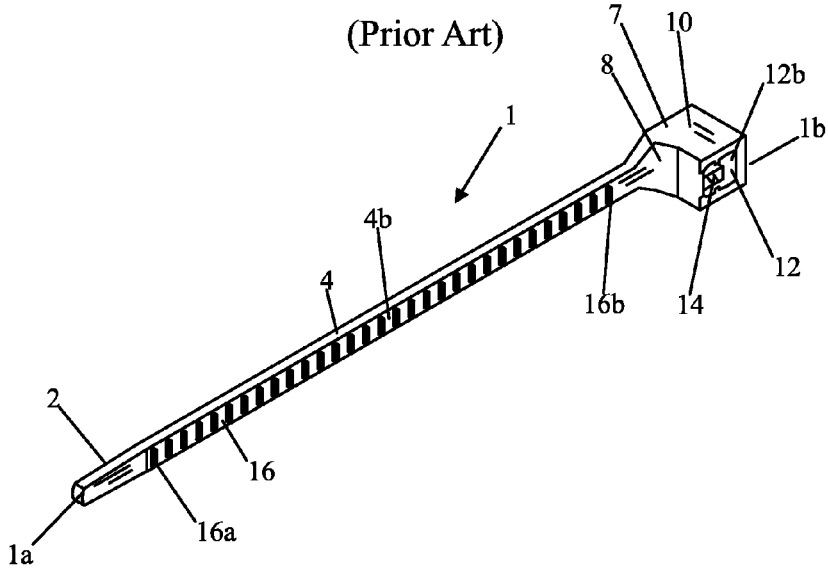
Fig. 2B (Prior Art)
FIG. 2B is a right, front, bottom view of the cable tie of FIG. 1A in an open state.

FIG. 1A is a left side view of a cable tie 1 of the prior art in an open state. FIG. 1B is a left, front, top perspective view of the cable tie 1 in an open state. FIG. 2A is a right side view of the cable tie 1 in an open state. FIG. 2B is a right, front, bottom view of the cable tie 1 in an open state.

Referring to FIGS. 1A-2B, the cable tie 1 includes a tapered portion 2, a body portion 4, and a fastener 7. The fastener 7 includes a tapered portion 8, a body portion 10, and a latching, retaining or locking mechanism 14. The fastener 7 has a first opening 12*a* leading to an inner chamber 12 which leads to a second opening 12*b*, opposite the first opening 12*a*. The body portion 4 includes a plurality of ridges or protrusions 6, including protrusion 6*a* and 6*b* shown in FIGS. 1A-B, and a plurality of ridges or protrusions 16, including protrusion 16*a* and 16*b* shown in FIGS. 2A-2B. The cable tie 1 has an end 1*a* and an opposing end 1*b*. The body portion 4 has a surface 4*a* shown in FIGS. 1A-B and a surface 4*b* shown in FIGS. 2A-2B.

Figure 3:
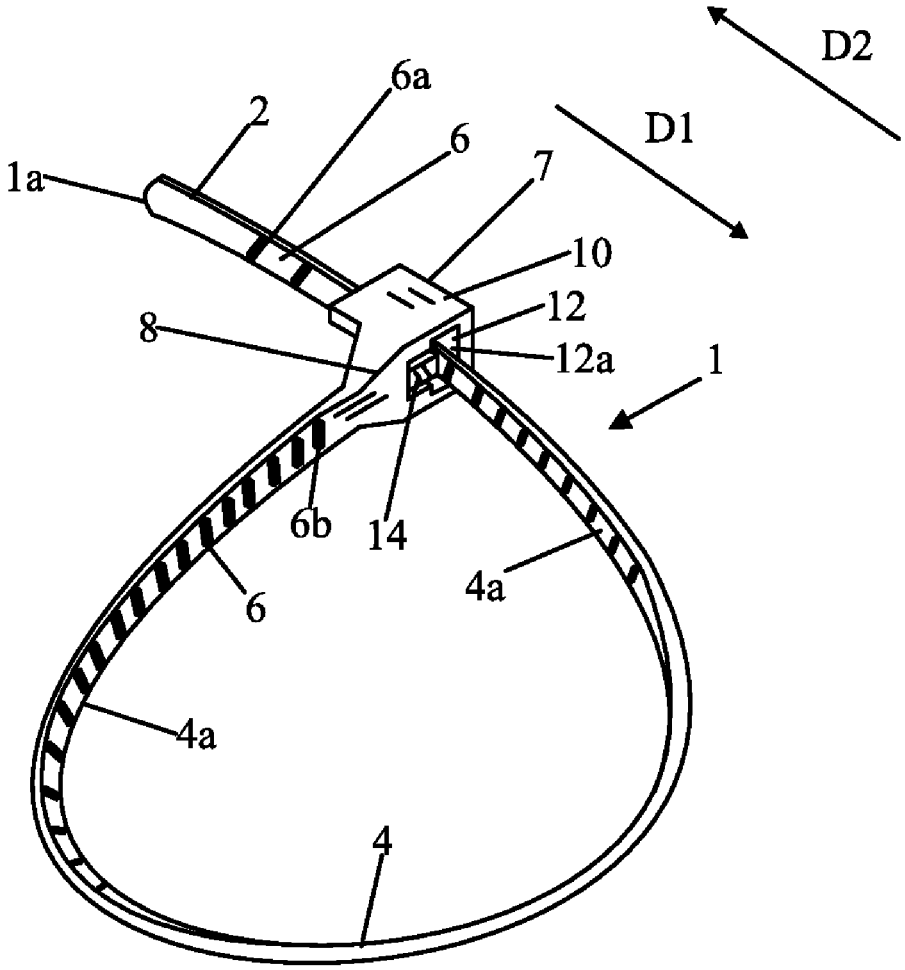
Fig. 3 (Prior Art)
FIG. 3 is a perspective view of the cable tie of FIG. 1A formed into a loop and in a closed state.

FIG. 3 is a perspective view of the cable tie 1 formed into a loop and in a closed state. In order to change the cable tie 1 from the open state of FIGS. 1A-2B into the closed state of FIG. 3, the end 1*a* is inserted into and through the inner chamber 12 by entering the opening 12*a*, passing through the inner chamber 12, and exiting the opening 12*b*. One or more of the ridges or protrusions 6 and 16 engage the latching, retaining, or locking mechanism 14, so that after the one or more ridges pass the mechanism 14 in the inner chamber 12 in the direction of the opening 12*b*, the combination of one or more ridges (such as 6*a* another ridges in FIG. 3) and the mechanism 14, prevent and/or inhibit the end 1*a* from being inserted back through the inner chamber 12 in the direction D1. The cable tie 1, may be constructed so that the mechanism 14 can be unlocked to allow the end 1*a* to be inserted back through the inner chamber 12 in the direction D1. However, typically the end 1*a* can be pulled further in the direction D2, without unlocking the mechanism 14, so that more protrusions of the protrusions 6 and 16 pass through the inner chamber 12 (via opening 12*a*, then inner chamber 12, then out opening 12*b*), so that a loop formed by inserting the end 1*a* into and through the inner chamber 12 (and fastener 7) can be made smaller to appropriately tighten the loop around a collection of items, such as a collection of wires or cables.

Figure 4A:
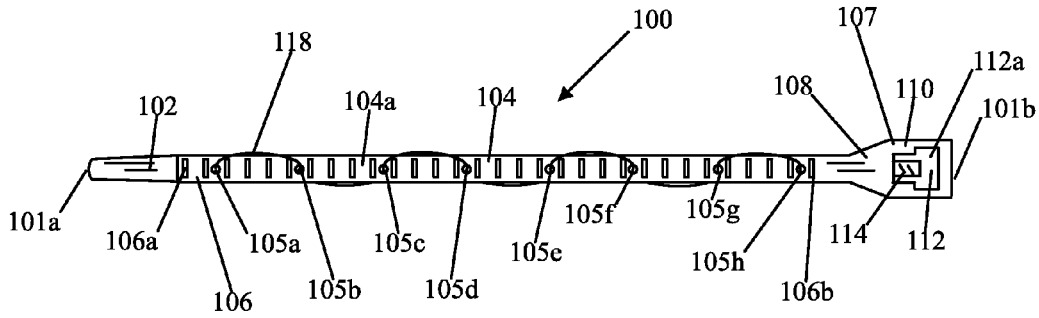
FIG. 4A is a left side view of an apparatus in accordance with an embodiment of the present invention, in an open state.
Figure 4B:
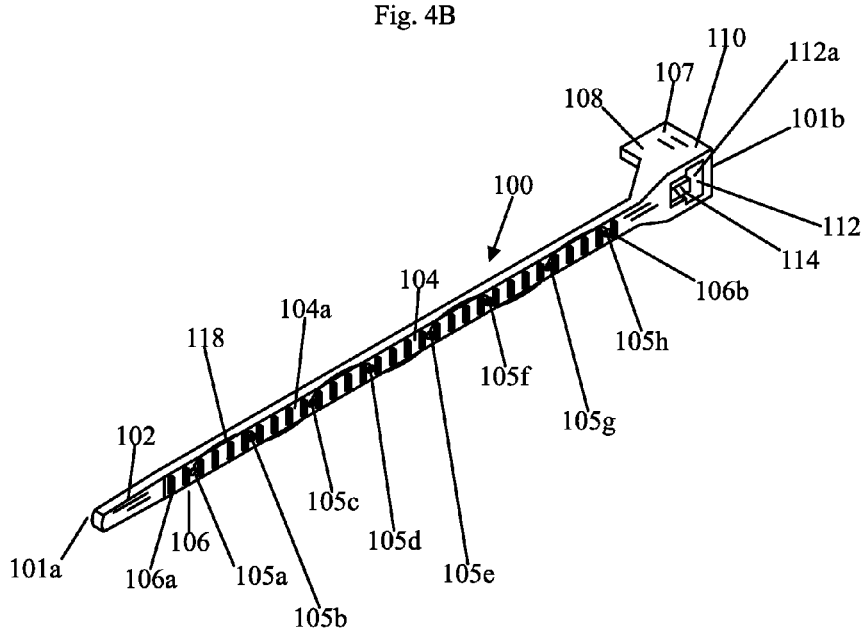
FIG. 4B is a left, front, top perspective view of the apparatus of FIG. 4A in a open state.
Figure 5A:
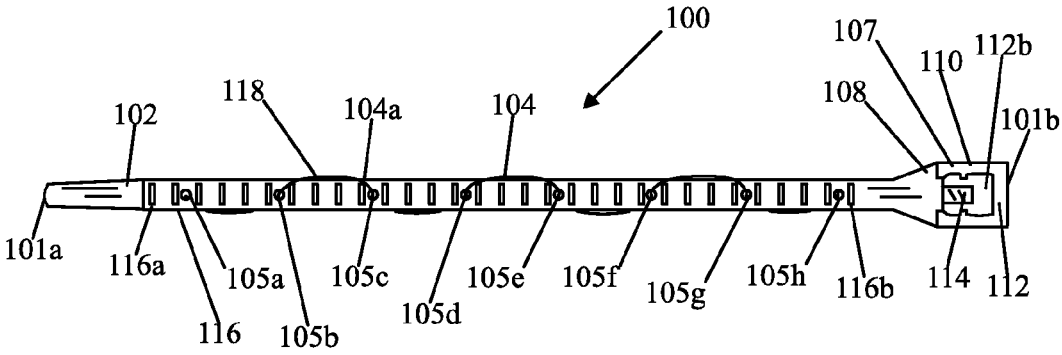
FIG. 5A is a right side view of the apparatus of FIG. 4A in an open state.
Figure 5B:
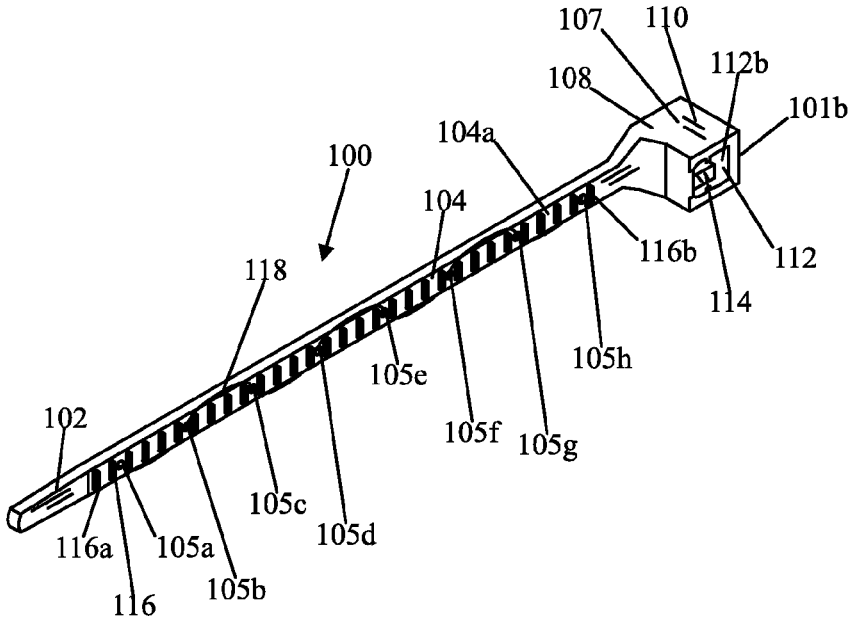
FIG. 5B is a right, front, bottom view of the apparatus of FIG. 4A in an open state.

FIG. 4A is a left side view of an apparatus 100 in accordance with an embodiment of the present invention, in an open state. FIG. 4B is a left, front, top perspective view of the apparatus 100 of FIG. 4A in an open state. FIG. 5A is a right side view of the apparatus 100 of FIG. 4A in an open state. FIG. 5B is a right, front, bottom view of the apparatus 100 of FIG. 4A in an open state. The apparatus 100 includes a tapered portion 102, a body portion 104, and a fastener 107. The tapered portion 102 and the fastener 107 may be similar to or identical to the tapered portion 2 and the fastener 7 of the cable tie 1 of FIGS. 1-2B. The apparatus 100 also includes a body portion 104. The body portion 104 has a plurality of openings 105*a*, 105*b*, 105*c*, 105*d*, 105*e*, 105*f*, 105*g*, and 105*h*, but otherwise may be similar to or identical to the body portion 4 of the cable tie 1 of FIGS. 1-2B. The apparatus 100 includes end 101*a*, end 101*b*, protrusions 106 including protrusions106*a* and 106*b*, surface 104*a* of body portion 104, and protrusions 116, including protrusions 116*a* and 116*b*. The fastener 107 includes tapered portion 108 body portion 110, latching, retaining, or locking mechanism 114, and inner chamber 112. An entrance opening 112*a*, leads into the inner chamber 112, and an exit opening 112*b* leads out the inner chamber 112.

The apparatus 100 includes a wire 118 or other non reforming material, which may be a continuous strand which is inserted through the openings 105*a*-105*h* in the body portion 104. The wire 118 is "non self reforming", or non-elastic, meaning that when the body portion 104 is bent or formed into a loop, the wire 118 will substantially or entirely keep the body portion 104 in the bent or loop state until a person bends the body portion 104 back to its original state. In contrast, the prior art body portion 4 of the cable tie 1, is typically elastic or self reforming, so that it will automatically go back to its original straightened state of FIGS. 1-2B, after an individual has removed a bending force.

The combination of the non self reforming or non elastic wire 118 and the typically elastic body portion 104, results in a combination material that is non self reforming and non elastic. The body portion 104 (in combination with the wire 118) can be bent or wound into different states, which remain after the bending force is removed, to bend the body portion 104 around pipes or other obstacles, which makes closing the apparatus 100 easier in certain environments.

Figure 6:
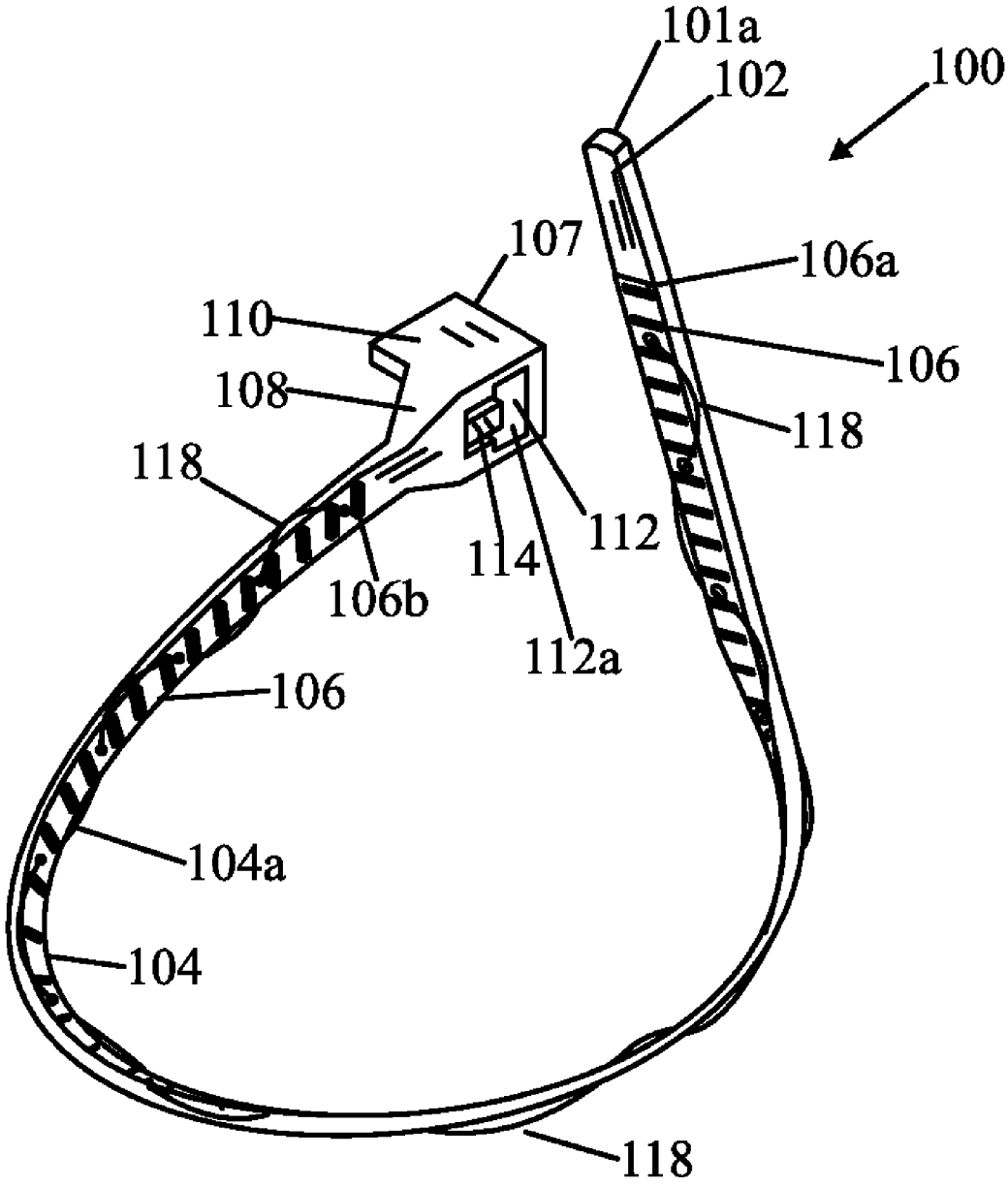
FIG. 6 is a perspective view of the apparatus of FIG. 4A, after the apparatus has been bent or formed into a loop or bent shape.

FIG. 6 is a perspective view of the apparatus 100 of FIG. 4A, after the apparatus 100 has been bent or formed into a loop or bent shape. The apparatus 100 retains the bent or loop shape shown in FIG. 6, in accordance with an embodiment of the present invention, after a bending force has been removed. The wire 118 is a non self reforming, non elastic material which keeps the apparatus 100 in the state of FIG. 6, when external forces (such as a person bending the apparatus 100) have been removed. The apparatus 100 retains the bent or looped form or state of FIG. 6, even though the end 101*a* has not been inserted into the opening 112*a* and through the inner chamber 112 of the fastener or device 107.

Figure 7A:
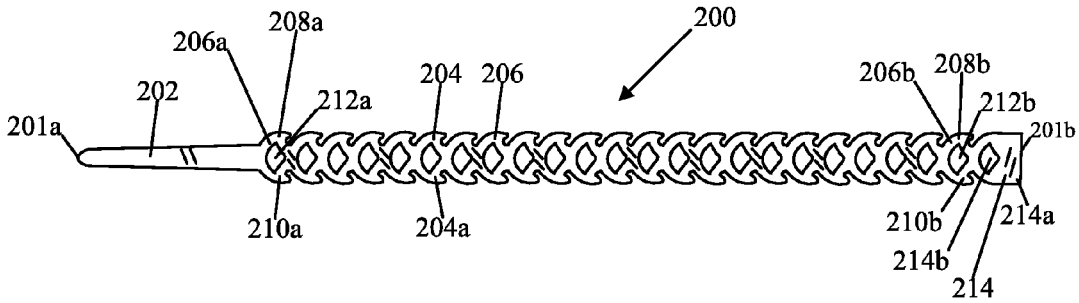
Fig. 7A (Prior Art)
FIG. 7A is a left side view of a cable tie of the prior art in an open state.
Figure 7B:
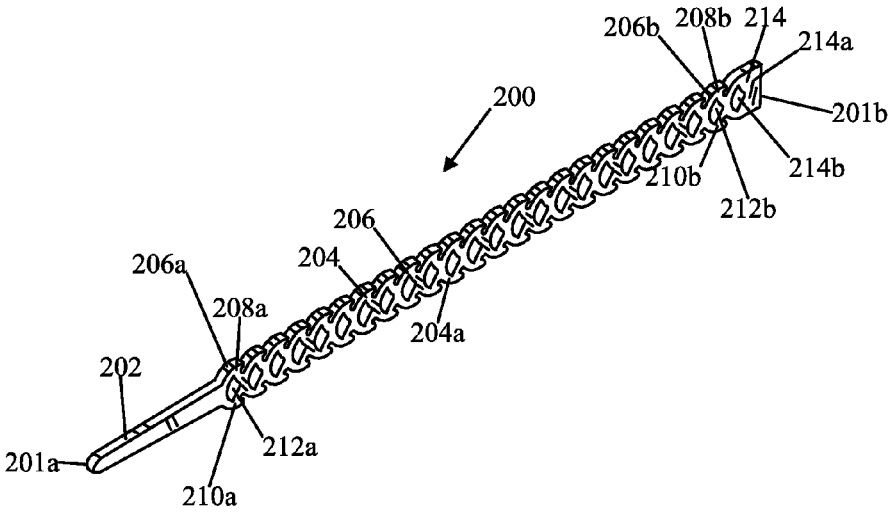
Fig. 7B (Prior Art)
FIG. 7B is a left, front, top perspective view of the cable tie of FIG. 7A in an open state.
Figure 8A:
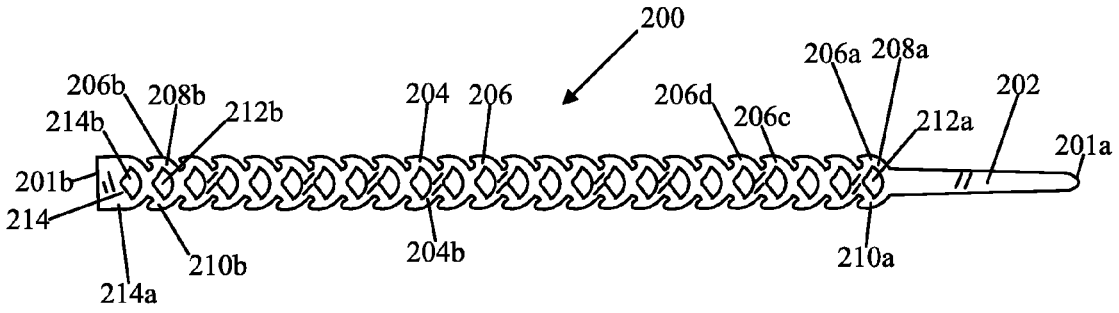
Fig. 8A (Prior Art)
FIG. 8A is a right side view of the cable tie of FIG. 7A in an open state.
Figure 8B:
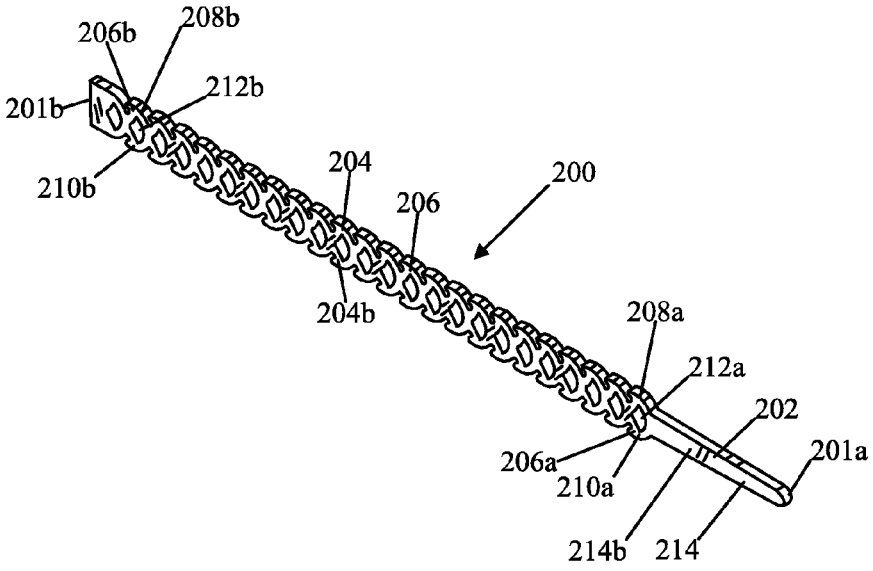
Fig. 8B (Prior Art)
FIG. 8B is a right, front, bottom view of the cable tie of FIG. 7A in an open state.

FIG. 7A is a left side view of a cable tie 200 of the prior art in an open state. FIG. 7B is a left, front, top perspective view of the cable tie 200 of FIG. 7A in an open state. FIG. 8A is a right side view of the cable tie 200 of FIG. 7A in an open state. FIG. 8B is a right, front, bottom view of the cable tie 200 of FIG. 7A in an open state.

Referring to FIGS. 7A-8B, the cable tie 200 includes a tapered portion 202, and a body portion 204. The cable tie 200 has an end 201*a* and an opposing end 201*b*. The body portion 204 includes a plurality of segments, cells, or attachment devices 206, including attachment devices 206*a* and 206*b*. The attachment devices 206*a* and 206*b* include upper sections 208*a* and 208*b*, lower sections 210*a* and 210*b*, and openings 212*a* and 212*b*, respectively. The body portion 204 also includes the end section 214 having a portion 214*a* and an opening 214*b*. The body portion 204 has a surface 204*a* shown in FIGS. 7A-7B and a surface 204*b* shown in FIGS. 8A-8B.

Figure 9:
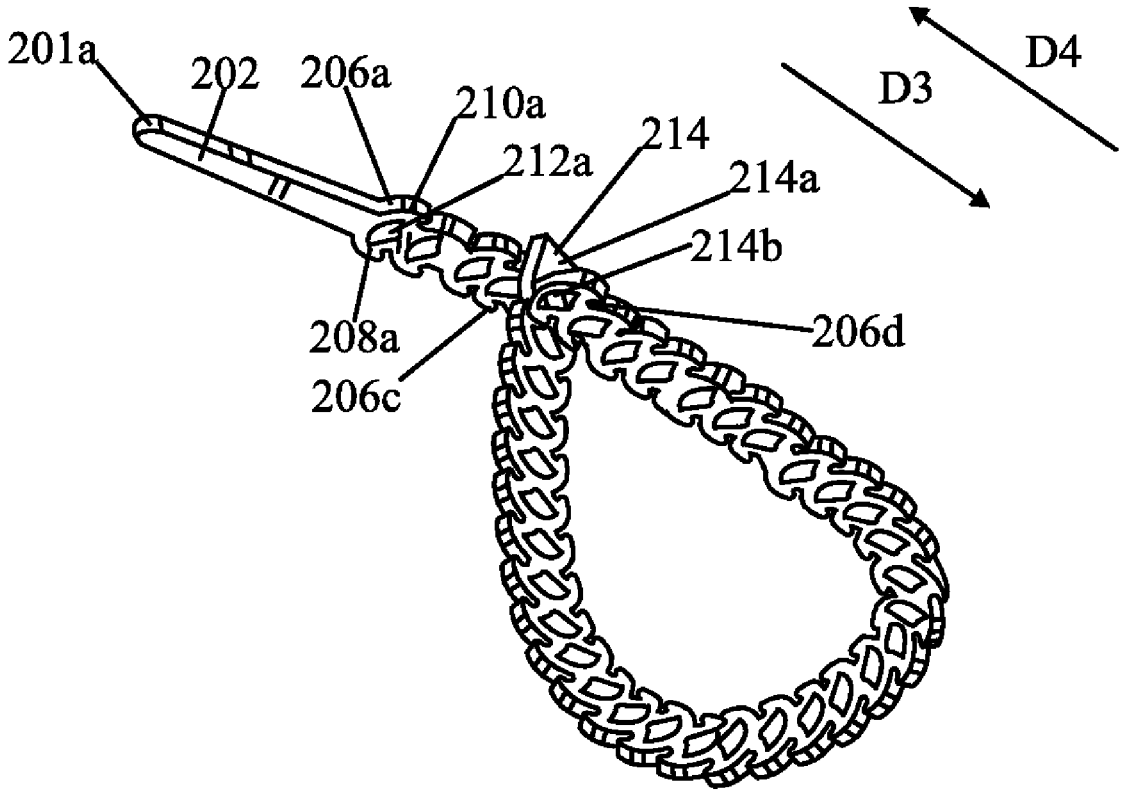
Fig. 9 (Prior Art)
FIG. 9 is a perspective view of the cable tie of FIG. 7A formed into a loop and in a closed state.

FIG. 9 is a perspective view of the prior art cable tie 200 of FIGS. 7A-8B formed into a loop and in a closed state. In order to change the cable tie 200 from the open state of FIGS. 7A-8B into the closed state of FIG. 9, the end 201*a* is inserted into and through the opening 214*b* in the end section 214. The end 201*a* could also be inserted into and through any of the openings of attachment devices 216, such as through opening 212*b* of attachment device 206*b*. One or more of the upper sections and lower sections of one or more of the attachment devices 206 bend or are otherwise deformed to allow them to pass through the opening 214*b* in the section 214. In FIG. 8, attachment devices 206*a*, 206*c*, and two attachment devices of 206 between 206*a* and 206*c*, have passed through the opening 214*b* in end section 214. Attachment device 206*d* of 206, has not passed through opening 214*b*. Once the upper and lower sections of the appropriate attachment devices of 206 have passed through the opening 214*b*, the upper and lower sections flex outward which prevents them from going back, in the direction D3, through the opening 214*b*, unless they are broken off. However, typically the end 201*a* can be pulled further in the direction D4, so that more attachment devices of 206, pass through the opening 214*b*, so that a loop formed by inserting the end 201*a* into and through the opening 214*b* can be made smaller to appropriately tighten the loop around a collection of items, such as a collection of wires or cables.

Figure 10A:
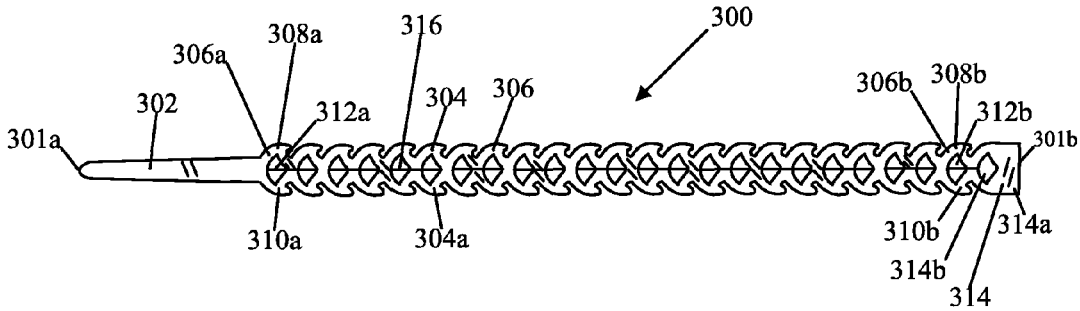
FIG. 10A is a left side view of an apparatus in accordance with another embodiment of the present invention, in an open state.
Figure 10B:
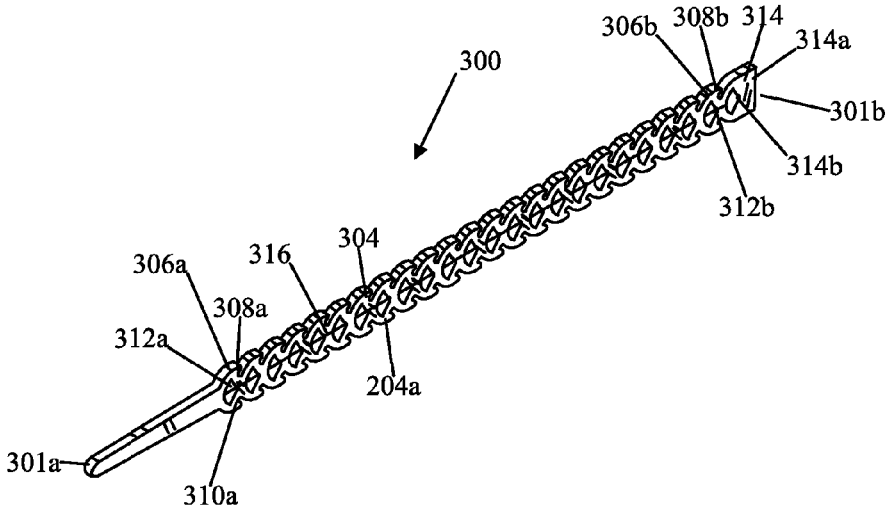
FIG. 10B is a left, front, top perspective view of the apparatus of FIG. 10A in a open state.
Figure 11A:
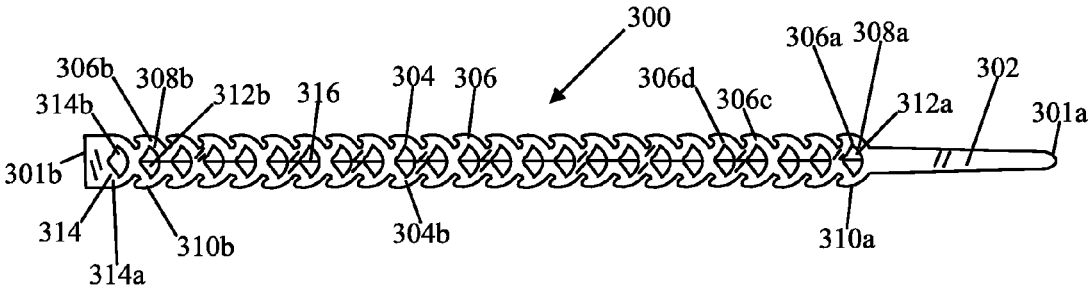
FIG. 11A is a right side view of the apparatus of FIG. 10A in an open state.
Figure 11B:
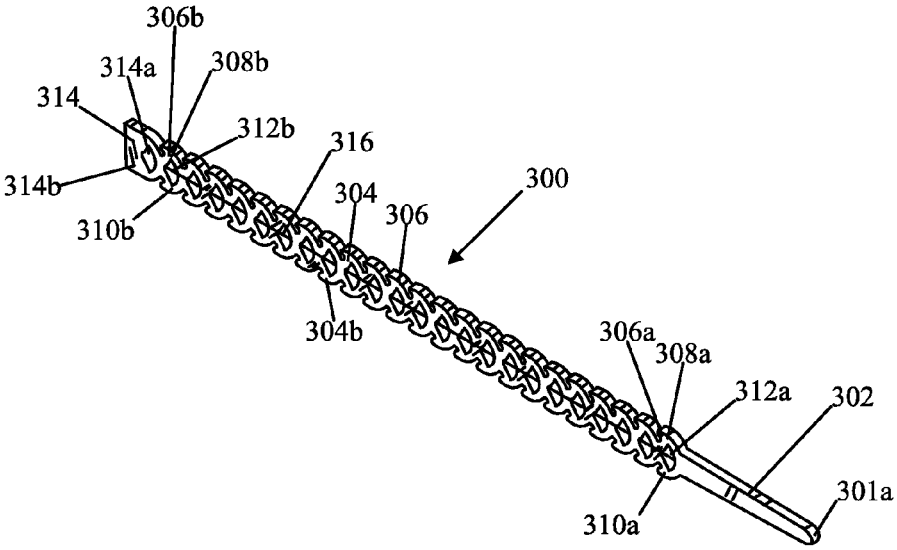
FIG. 11B is a right, front, bottom view of the cable tie of FIG. 10A in an open state.

FIG. 10A is a left side view of an apparatus 300 in accordance with another embodiment of the present invention, in an open state. FIG. 10B is a left, front, top perspective view of the apparatus 300 of FIG. 10A in a open state. FIG. 11A is a right side view of the apparatus 300 of FIG. 10A in an open state. FIG. 11B is a right, front, bottom view of the apparatus 300 of FIG. 10A in an open state.

The apparatus 300 includes a tapered portion 302, and a body portion 304. The tapered portion 302 and the body portion 304 may be similar to or identical to the tapered portion 202 and the body portion 204, respectively of the cable tie 200 of FIGS. 7A-8B. The apparatus 300 has an end 301*a* and an opposing end 301*b*. The body portion 304 includes a plurality of segments, cells, or attachment devices 306, including attachment devices 306*a*, 306*b*, 306*c*, and 306*d*. The attachment devices 306*a* and 306*b* include upper sections 308*a* and 308*b*, lower sections 310*a* and 310*b*, and openings 312*a* and 312*b*, respectively. The body portion 304 also includes the end section 314 having a portion 314*a* and an opening 314*b*. The body portion 304 has a surface 304*a* shown in FIGS. 10A-10B and a surface 304*b* shown in FIGS. 11A-11B.

The apparatus 300 includes a wire 316 or other non reforming material, which may be a continuous strand which is inserted through the openings of the attachment devices 306, such as openings 312*a* and 312*b* in the body portion 304. The wire 316 is "non self reforming", or non-elastic, meaning that when the body portion 304 is bent or formed into a loop, the wire 316 will substantially or entirely keep the body portion 304 in the bent or loop state until a force is exerted, such as by a person, to bend the body portion 304 back to its original state. In contrast, the prior art body portion 204 of the cable tie 200, is typically elastic or self reforming, so that it will automatically go back to its original straightened state of FIGS. 7A-8B, after an individual has removed a bending force, and assuming one or more of attachment devices 206 have not been inserted through one of openings of attachment devices 206 (such as opening 212*b* of attachment device 206*b*) or opening 214*b* of end section 214 as in FIG. 9.

The combination of the non self reforming or non elastic wire 316 and the typically elastic body portion 304, results in a combination material that is non self reforming and non elastic. The body portion 304 (in combination with the wire 316) can be bent or wound into different states, which remain after the bending force is removed, to bend the body portion 304 around pipes or other obstacles, which makes closing the apparatus 300 easier in certain environments.

The body portion 104 of the apparatus 100 and the body portion 304 of the apparatus 300 may be comprised substantially or entirely of a bendable plastic strap that that is resiliently flexible. The wire 118 shown in FIG. 4A-5B and the wire 316 shown in FIGS. 10A-11B may each be a bendable, shapeable, substantially non self reforming wire. The wire 118 may be woven through openings 105*a*-*h* in the apparatus 100. The wire 316 may be woven through openings in attachment devices 306, such as opening 312*a*, in the apparatus 300. The wires 118 and 316 may be detached from the cable strap or body portions 104 and 304 respectively, by pulling an end of the respective wire.

Instead of being woven through openings, the wires 118 and 316 can be embedded in the body portions 104 and 304. If embedded the wires 118 and 316 may not, in one embodiment, be not selectively attachable or detachable from the appropriate plastic strap or body portion 104 and 304, respectively.

Figure 12A:
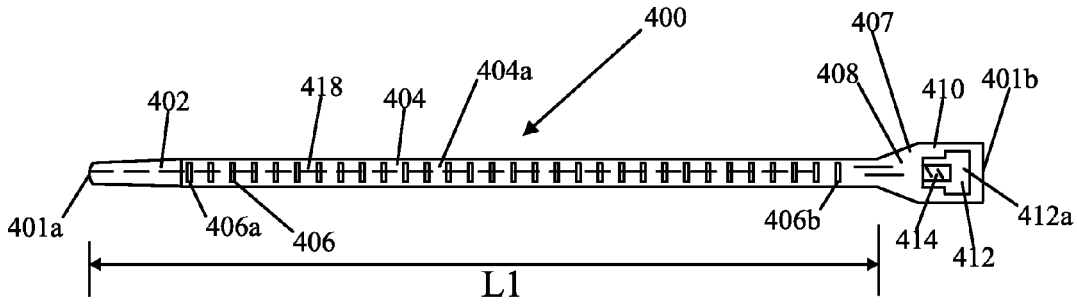
FIG. 12A is a left side view of an apparatus in accordance with another embodiment of the present invention, in an open state.
Figure 12B:
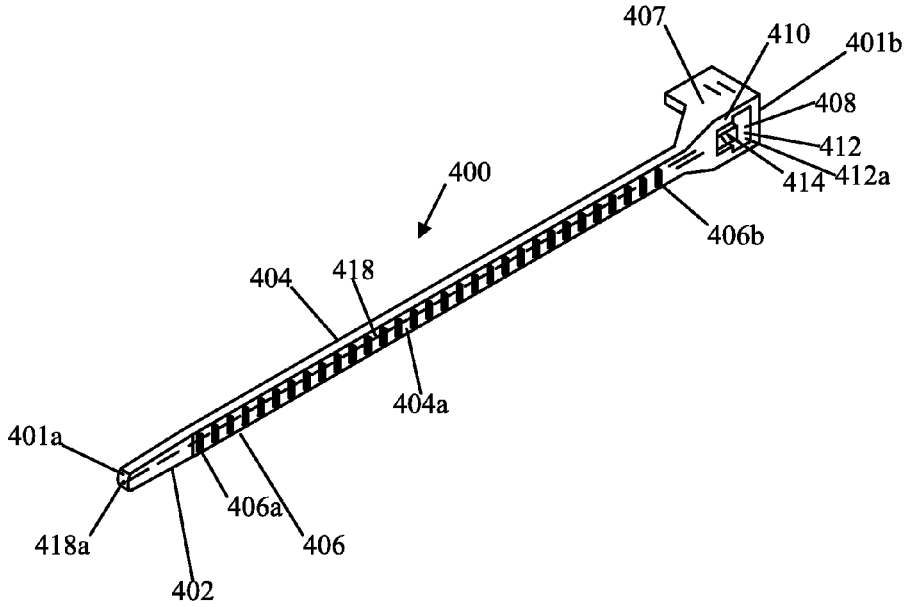
FIG. 12B is a left, front, top perspective view of the apparatus of FIG. 12A in a open state.
Figure 13A:
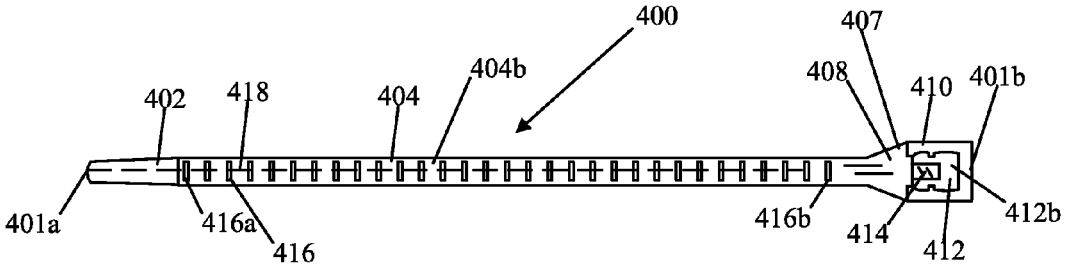
FIG. 13A is a right side view of the apparatus of FIG. 12A in an open state.
Figure 13B:
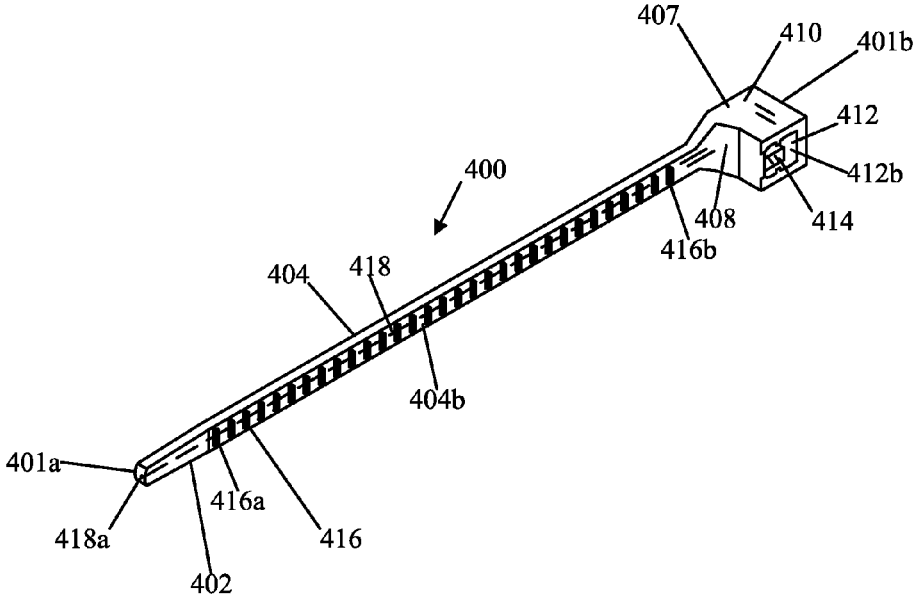
FIG. 13B is a right, front, bottom view of the cable tie of FIG. 12A in an open state.

FIG. 12A is a left side view of an apparatus 400 in accordance with another embodiment of the present invention in an open state. FIG. 12B is a left, front, top perspective view of the apparatus 400 in an open state. FIG. 13A is a right side view of the apparatus 400 in an open state. FIG. 13B is a right, front, bottom view of the apparatus 400 in an open state.

Referring to FIGS. 12A-13B, the apparatus 400 includes a tapered portion 402, a body portion or strap 404, and a fastener 407. The fastener 407 includes a tapered portion 408, a body portion 410, and a latching, retaining or locking mechanism 414. The fastener 407 has a first opening 412*a* leading to an inner chamber 412 which leads to a second opening 412*b*, opposite the first opening 412*a*. The body portion 404 includes a plurality of ridges or protrusions 406, including protrusion 406*a* and 406*b* shown in FIGS. 12A-B, and a plurality of ridges or protrusions 416, including protrusion 416*a* and 416*b* shown in FIGS. 13A-13B. The apparatus 400 has an end 401*a* and an opposing end 401*b*. The body portion 404 has a surface 404*a* shown in FIGS. 12A-B and a surface 404*b* shown in FIGS. 13A-13B.

The apparatus 400 may be identical to the cable tie 1 of FIGS. 1A-2B, except for a wire 418 which is embedded inside the body portion 404 and the tapered portion 402. The wire 418 is shown by dashed lines in FIGS. 12A-13B. An end 418*a* of the wire 418 may be visible at end 401*a* of the apparatus 400. The wire 418 may be embedded in all of portion 404 and portion 402, or may be embedded in only part of portions 404 and 402. The wire 418 is a non self reforming material or non elastic material, such as a low carbon steel wire. The apparatus 400 can be bent or formed into a loop, similar to as shown for apparatus 100 in FIG. 6, and the wire 418 will keep the apparatus 400 in the loop or bent state, unless an external force bends the apparatus 400 back to the state shown in FIGS. 12A-13B.

In one embodiment, the wire 418 may be centered along approximately two-thirds of the body portion 404. The combination of portions 402 and 404 may be called a strap. In at least one embodiment the wire 418 may be embedded in the strap (402 and 404) and may run about ⅔ of the length, L1 of strap (402 and 404). The wire 418 may be centered longitudinally in the strap (402 and 404) and equatorially inside the strap (402 and 404).

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A cable tie comprising a strap portion having a first end and an opposing second end;

a fastener connected to the second end of the strap portion;

wherein the strap portion is comprised of a first material which causes the strap portion to be non self reforming so that the strap portion can be bent from an equilibrium state to a bent state by a bending force which does not exceed a plasticity point for the strap portion, and the strap portion does not reform itself back to the equilibrium state upon removal of the bending force;

wherein the strap portion has a length and a width, wherein the length is substantially greater than the width;

wherein the first material extends along the length of the strap portion a distance at least as great as the width, is substantially parallel to the length of the strap portion, and does not protrude out at an angle to the length of the strap portion;

wherein the strap portion is comprised of a second material which protrudes out at an angle to the length of the strap portion;

wherein the first end of the strap portion and the fastener are configured so that the first end, and a portion of the second material adjacent the first end, can be inserted into and through an opening of the fastener and after the first end, and the portion of the second material adjacent the first end, have been inserted into and through the opening of the fastener, the first end cannot be pulled back through the opening of the fastener without unlocking a mechanism of the fastener;

wherein the portion of the second material adjacent the first end prevents the first end from being pulled back through the opening of the fastener unless the mechanism of the fastener is unlocked;

wherein the first material does not prevent the first end from being pulled back through the opening of the fastener; and wherein the first material is configured so that the first material does not extend into the opening of the fastener or on the fastener, such that when the first end of the strap portion is inserted into and through the opening of the fastener, the first material does not engage the first end of the strap portion, and the first material does not directly contact the fastener.

2. The cable tie of claim 1 wherein the strap portion and the fastener are integrated into one piece.

3. The cable tie of claim 1 wherein the first material is a soft bendable metal wire.

4. The cable tie of claim 1 wherein the first material is a metal alloy.

5. The cable tie of claim 1 wherein the first material is a polymer.

6. The cable tie of claim 1 wherein the first material is a metal wire.

7. The cable tie of claim 1 wherein the first material is a shape memory alloy.

8. The cable tie of claim 1 wherein the strap portion and the fastener are bio-degradable.

9. The cable tie of claim 1 wherein the strap portion includes a body portion in addition to the first material;

and wherein the first material can be selectively detached from the body portion of the strap portion.

10. The cable tie of claim 1 wherein the strap portion includes a body portion in addition to the first material;

and wherein the first material can not be detached from the body portion of the strap portion without breaking the strap portion.

11. The cable tie of claim 1 wherein the first material extends to the first end of the strap portion.

12. A cable tie comprising a strap portion having a first end and a second end, and having a plurality of connected cells between the first end and the second end;

wherein each of the plurality of connected cells form an enclosed aperture bounded by wall portions, so that a plurality of enclosed apertures are formed corresponding to the plurality of connected cells, each enclosed aperture allowing passage of one or more of the plurality of connected cells, wherein a loop can be formed by inserting the first end of the strap portion through a first enclosed aperture of the plurality of enclosed apertures;

wherein the plurality of connected cells are configured so that the first end of the strap portion and one or more of the plurality of connected cells can be inserted into and through an enclosed aperture of a first connected cell of the plurality of connected cells and after the first end and the one or more of the plurality of connected cells has been inserted into and through the enclosed aperture of the first connected cell of the plurality of connected cells, one or more wall portions of one or more of the plurality of connected cells inhibit the first end from being moved back through the enclosed aperture of the first connected cell of the plurality of connected cells; and wherein the strap portion is comprised of a first material which causes the strap portion to be non self reforming so that the strap portion can be bent from an equilibrium state to a bent state by a bending force which does not exceed a plasticity point for the strap portion, and the strap portion does not reform itself back to the equilibrium state upon removal of the bending force;

wherein the strap portion has a length and a width, wherein the length is substantially greater than the width;

wherein the first material extends along the length of the strap portion a distance at least as great as the width, is substantially parallel to the length of the strap portion, and does not protrude out at an angle to the length of the strap portion;

wherein the strap portion is comprised of a second material which protrudes out at an angle to the length of the strap portion;

wherein the one or more wall portions are made up of the second material and after the first end and the one or more of the plurality of connected cells has been inserted into and through the enclosed aperture of the first connected cell of the plurality of connected cells, the second material of the one or more wall portions of one or more of the plurality of connected cells inhibit the first end from being moved back through the enclosed aperture of the first connected cell of the plurality of connected cells;

and wherein the first material does not inhibit the first end from being moved back through the enclosed aperture of the first connected cell of the plurality of connected cells.

13. The apparatus of claim 12 wherein the first material is a metal wire.

14. The apparatus of claim 12 wherein the first material is a steel alloy wire.

15. The cable tie of claim 12 wherein the strap portion includes a body portion in addition to the first material;

and wherein the body portion is made of the second material which is resiliently flexible and self reforming;

and wherein the first material is embedded in the body portion.

16. The cable tie of claim 12 wherein the first material is configured so that the first material does not extend into the enclosed aperture of the first connected cell, such that when the first end of the strap portion is inserted into and through the enclosed aperture of the first connected cell, the first material does not engage the first end of the strap portion.

17. A cable tie comprising a strap portion having a first end and an opposing second end;

a fastener connected to the second end of the strap portion;

wherein the strap portion is comprised of a first material which causes the strap portion to be non self reforming so that the strap portion can be bent from an equilibrium state to a bent state by a bending force which does not exceed a plasticity point for the strap portion, and the strap portion does not reform itself back to the equilibrium state upon removal of the bending force;

wherein the strap portion has a length and a width, wherein the length is substantially greater than the width;

wherein the first material extends along the length of the strap portion a distance at least as great as the width, is substantially parallel to the length of the strap portion, and does not protrude out at an angle to the length of the strap portion;

wherein the strap portion is comprised of a second material which protrudes out at an angle to the length of the strap portion;

wherein the first end of the strap portion and the fastener are configured so that the first end, and a portion of the second material adjacent the first end, can be inserted into and through an opening of the fastener and after the first end, and the portion of the second material adjacent the first end, have been inserted into and through the opening of the fastener, the first end cannot be pulled back through the opening of the fastener without unlocking a mechanism of the fastener;

wherein the portion of the second material adjacent the first end prevents the first end from being pulled back through the opening of the fastener unless the mechanism of the fastener is unlocked;

wherein the first material does not prevent the first end from being pulled back through the opening of the fastener; wherein the strap portion includes a body portion; and wherein the first material is woven through apertures that traverse the body portion.

18. A cable tie comprising a strap portion having a first end and an opposing second end;

a fastener connected to the second end of the strap portion;

wherein the strap portion is comprised of a first material which causes the strap portion to be non self reforming so that the strap portion can be bent from an equilibrium state to a bent state by a bending force which does not exceed a plasticity point for the strap portion, and the strap portion does not reform itself back to the equilibrium state upon removal of the bending force;

wherein the strap portion has a length and a width, wherein the length is substantially greater than the width;

wherein the first material extends along the length of the strap portion a distance at least as great as the width, is substantially parallel to the length of the strap portion, and does not protrude out at an angle to the length of the strap portion;

wherein the strap portion is comprised of a second material which protrudes out at an angle to the length of the strap portion;

wherein the first end of the strap portion and the fastener are configured so that the first end, and a portion of the second material adjacent the first end, can be inserted into and through an opening of the fastener and after the first end, and the portion of the second material adjacent the first end, have been inserted into and through the opening of the fastener, the first end cannot be pulled back through the opening of the fastener without unlocking a mechanism of the fastener;

wherein the portion of the second material adjacent the first end prevents the first end from being pulled back through the opening of the fastener unless the mechanism of the fastener is unlocked;

wherein the first material does not prevent the first end from being pulled back through the opening of the fastener; wherein the strap portion includes a body portion, wherein the body portion is made of the second material, which is self reforming and bendable wherein the first material is embedded in at least part of the body portion.

* * * * *